US006358338B1

(12) United States Patent
Guelton et al.

(10) Patent No.: US 6,358,338 B1
(45) Date of Patent: Mar. 19, 2002

(54) PROCESS FOR MANUFACTURING STRIP MADE OF AN IRON-CARBON-MANGANESE ALLOY, AND STRIP THUS PRODUCED

(75) Inventors: Nicolas Guelton; Michel Faral; Odile Faral, all of Metz (FR)

(73) Assignee: Usinor, Puteaux (FR)

( * ) Notice: Subject to any disclaimer, the term of this patent is extended or adjusted under 35 U.S.C. 154(b) by 0 days.

(21) Appl. No.: 09/612,415

(22) Filed: Jul. 7, 2000

(30) Foreign Application Priority Data

Jul. 7, 1999 (FR) ..... 99 08758

(51) Int. Cl.[7] ..... C21D 6/02
(52) U.S. Cl. ..... 148/547; 148/619; 148/620
(58) Field of Search ..... 148/541, 547, 148/619, 620; 420/73

(56) References Cited

U.S. PATENT DOCUMENTS 5,571,343 A * 11/1996 Ryoo et al. ..... 148/325

FOREIGN PATENT DOCUMENTS

| | | | |
|---|---|---|---|
| JP | 02-258931 A | * | 10/1990 |
| JP | 02-263928 A | * | 10/1990 |
| JP | 02-263931 A | * | 10/1990 |
| WO | WO 93-13233 | | 7/1993 |
| WO | WO 95/26423 | | 10/1995 |
| WO | WO 97/24467 | | 7/1997 |

OTHER PUBLICATIONS

Patent Abstracts of Japan, vol. 016, No. 375, Aug. 12, 1992; & JP 04 120252, Apr. 21, 1992.
Patent Abstracts of Japan, vol. 014, No. 431, Sep. 17, 1990; & JP 02 166233, Jun. 26, 1990.
"ASM Handbook: Casting", vol. 15, ASM International, (1988), pp733–734.*

* cited by examiner

*Primary Examiner*—George Wyszomierski
*Assistant Examiner*—Janelle Combs-Morillo
(74) *Attorney, Agent, or Firm*—Oblon, Spivak, McClelland, Maier & Neustadt, P.C.

(57) ABSTRACT

The invention relates to a process for producing strip made of an iron-carbon-manganese alloy, in which:

a thin strip, having a thickness of 1.5 to 10 mm, is cast directly on a casting machine from a liquid metal of composition, in percentages by weight: C ranging between 0.001 and 1.6%; Mn ranging between 6 and 30%; Ni≦10% with (Mn+Ni) ranging between 16 and 30%; Si≦2.5%; Al≦6%; Cr≦10%; (P+Sn+Sb+As)≦0.2%; (S+Se+Te)≦0.5%; (V+Ti+Nb+B+Zr+rare earths)≦3%; (Mo+W)≦0.5%; N≦0.3%; Cu≦5%, the balance being iron and impurities resulting from the smelting;

the said strip is cold rolled with a reduction ratio ranging between 10 and 90% in one or more steps; and the said strip undergoes recrystallization annealing.

The invention also relates to a strip that can be produced by this process.

14 Claims, No Drawings

PROCESS FOR MANUFACTURING STRIP MADE OF AN IRON-CARBON-MANGANESE ALLOY, AND STRIP THUS PRODUCED

The invention relates to the manufacture of strip made of ferrous alloys. More particularly it relates to the manufacture of strip made of an iron-carbon-manganese alloy by direct casting in the form of thin strip.

Hadfield steels, comprising Fe—Mn(11 to 14%)-C (1.1 to 1.4%), which may be termed "high manganese steels", have been known for a long time. They have the feature of being very strong and able to undergo ageing under the effect of repeatedly applied friction forces or impacts. Also known are austenitic steels of the Fe—Mn(15 to 35%)-Al (0 to 10%)-Cr (0 to 20%)-C (0 to 1.5%) type which derive simultaneously from Hadfield steels and from Fe—Cr—Ni austenitic stainless steels in which the nickel is progressively replaced by manganese and the chromium progressively replaced by aluminium. These high manganese steels are characterized by a high work-hardenability which allows them to combine a high strength level with excellent ductility. Thus, they can be advantageously used for the manufacture of reinforcing elements manufactured for the motor-vehicle industry by drawing or stamping. These steels owe their high work-hardenability to mechanical twinning, possibly enhanced by the $\gamma \rightarrow \epsilon$ martensitic transformation. By propagating, the twins facilitate plastic deformation but, where mutually impeding one another, they also contribute to increasing the yield stress.

Various documents discuss the composition and the manufacture of such very-high manganese steels, for example WO 93/13233, WO 95/26423, WO 97/24467. These steels have always, until now, been manufactured by the conventional process of continuous casting of thick slabs approximately 200 mm in thickness/hot rolling/cold rolling/annealing/pickling/skin-pass. This process essentially has three drawbacks. Firstly its cost, due to the use of a strip mill which is a plant requiring a very high investment and consuming a great deal of energy, since it is needed to greatly reheat the slabs before they are rolled. Secondly, there is a risk of the strip hot-cracking during this reheat, during which a thick layer of scale also forms, this being unfavourable both to the surface quality of the product and to the metallurgical efficiency of the manufacturing process. Thirdly, overall, it is a long manufacturing process not always making it possible to react promptly to a pressing demand on the part of a customer.

The object of the invention is to propose a method of manufacturing strip made of ferrous alloys having a high manganese content more rapidly and less expensively than the known conventional method and making it possible to obtain products at least as good in quality as those by that previous method.

For this purpose, the subject of the invention is a process for producing strip made of an iron-carbon-manganese alloy, in which:

- a thin strip, having a thickness of 1.5 to 10 mm, is cast directly on a casting machine from a liquid metal of composition, in percentages by weight: C ranging between 0.001 and 1.6%; Mn ranging between 6 and 30%; Ni≦10% and with (Mn+Ni) ranging between 16 and 30%; Si≦2.5%; Al≦6%; Cr≦10%; (P+Sn+Sb+As) ≦0.2%; (S+Se+Te)≦0.5%; (V+Ti+Nb+B+Zr+rare earths)≦3%; (Mo+W)≦0.5%; N≦0.3%; Cu≦5%; the balance being iron and impurities resulting from the smelting;
- the said strip is cold rolled with a reduction ratio ranging between 10 and 90% in one or more steps; and

- the said strip undergoes recrystallization annealing.

The invention also relates to a strip that can be produced by this process.

As will have been understood, the invention relies firstly on the use of a process for casting liquid metal directly in the form of a thin strip. The latter may possibly undergo in-line hot rolling by means of a plant of small size, the manufacturing and running cost of which is very much less than that of a strip mill. In addition, the omission of the hot rolling on a strip mill eliminates the risks of hot cracking during the reheat of which mention was made. Following thereafter are cold-rolling, annealing and possibly skin-pass operations, the execution of which, according to the embodiments which will be specified, allows the desired product properties to be obtained.

The invention will be more clearly understood on reading the description which follows.

The process of directly casting thin steel strip from 1.5 to 10 mm thickness is well known at the present time, especially in its form called "twin-roll casting". The liquid steel solidifies against the side walls of two closely spaced horizontal rolls, which are internally cooled and rotating in opposite directions, and emerges beneath the rolls in the form of a solidified strip. The latter may be coiled directly and then sent to the cold-processing plants, or may undergo in-line hot rolling before being coiled. According to the invention, the use of such a process makes it possible to shorten the process for manufacturing strip made of high manganese steel by eliminating the pass through the strip mill, whereas this pass is necessary in the conventional process which begins by casting slabs. This elimination is all the more advantageous when the high manganese austenitic steels are characterized by the absence of a phase transformation while they are being cooled. This is because one of the conventional functions of the hot rolling of ferritic, carbon or stainless steels is the refinement of the microstructure just before the phase transformation occurs. However, high manganese steels, which offer the best strength/ductility compromise at the forming temperature are completely austenitic, at least before deformation, from their point of solidification to the end of their cooling. Therefore there is no significant metallurgical advantage in hot rolling high manganese austenitic steels. Its function is limited to a simple thickness reduction of the product in order to obtain a strip capable of being cold rolled. In such cases, there is therefore no drawback in obtaining, by thin strip casting, a strip having a thickness relatively close to its final thickness, as long as the said strip is free of any central porosity after it has been cast. Light in-line hot rolling, as described above, is sufficient to close up any such porosity.

The invention applies to the manufacture of high manganese steels which have the following composition, the percentages being percentages by weight:

- their carbon content ranges between 0.001 and 1.6%, preferably between 0.2 and 0.8%; a content of less than 0.2% requires the pool of liquid steel to be decarburized, which can be expensive to carry out, particularly when manganese is already present in a significant quantity; moreover, this minimum amount of 0,2% allows to obtain an interaction between carbon and dislocations:carbon, by locking the dislocations, allows a further hardening compared to twinning, and allows to improve the tensile strength by 50 to 100 Mpa; an amount greater than 0.8% makes it more difficult to optimize the contents of the other alloying elements for the purpose of obtaining the most favourable mechanical properties;

their manganese content ranges between 6 and 30%, bearing in mind that the total of their manganese and nickel contents ranges between 16 and 30% and that their nickel content may range up to 10%;

their silicon content may range up to 2.5%, bearing in mind that this element is only optional;

their aluminium content is less than 6%, bearing in mind that this element is only optional;

if chromium is present, the chromium content is at most 10%;

their phosphorus content may range up to 0.2%, it being known that tin, antimony and arsenic, which may possibly be present, are, from this standpoint, similar to phosphorus and compatibilized with it in the composition of the steel; above this level, there is a risk of obtaining defects in the segregated zones of the strip; these defects are caused by delays in the solidification at the point where segregation occurs; if the product is hot rolled while metal in the liquid state is still present in places in the products, there is consequently a risk of loss of cohesion of the microstructure;

the total of their sulphur, selenium and tellurium contents may range up to 0.5%;

the total of their vanadium, titanium, niobium, boron, tantalum, zirconium and rare-earth contents, which precipitate nitrides and carbonitrides, may range up to 3%;

the total of their molybdenum and tungsten contents may range up to 0.5%; and their nitrogen content may range up to 0.3%.

According to the invention, a very-high manganese steel having a composition as defined above (a typical example of such a composition is Fe—C: 0.55%—Mn: 21.5%) is cast in the form of thin strip having a thickness of 1.5 to 10 mm, directly from liquid metal. For this purpose, the twin-roll casting of strip having a thickness of about 3 to 4 mm is particularly suitable for implementing the process according to the invention.

As the strip exits the rolls, it preferably passes through a zone such as a chamber inerted by blowing in a gas, in which the strip is subjected to a non-oxidizing environment (an inert nitrogen or argon atmosphere, or even an atmosphere containing a certain proportion of hydrogen in order to make it reducing), in order to prevent or limit the formation of scale on its surface. It has been noted that steels of the cast type are particularly sensitive to the formation of scale and it is less difficult to limit this formation on thin strip cast directly from liquid metal than on thick slabs that have to be cast in a conventional continuous casting plant and then reheated before they are hot rolled. At the exit of this inerting zone may also be placed a device for descaling the strip by shot blasting or by blasting solid $CO_2$ onto its surface or by brushing, so as to remove the scale which could have formed, despite the precautions taken. It is also possible to choose to leave the scale to form naturally, without seeking to inert the atmosphere surrounding the strip, and then to remove this scale by a device like the one just described.

As soon as possible immediately after the strip has left the inerting or descaling plant, this same strip preferably undergoes in-line hot rolling. However, this is not obligatory if the strip is immediately satisfactory in terms of porosity and surface finish. To a large extent, it is this rolling which justifies the measures preferably taken to avoid or limit the formation of scale, and/or to remove the scale which could have formed. This is because carrying out this hot rolling on a strip having a layer of scale could result in the scale becoming encrusted into the surface of the strip, which would degrade its surface quality. The essential role of this hot rolling is to close up any pores liable to have been formed in the core of the strip during its solidification and to improve its surface finish by flattening the roughness peaks possibly present on the surface of the strip, particularly when casting rolls with a high roughness have been used. The minimum reduction ratio to be applied to the strip during this hot rolling is 10% if it is desired to close up the pores correctly, and typically 20%. However, a ratio of up to 60% (obtained in one or more steps) is conceivable, particularly if what is required is a strip having a high surface roughness or if it is desired to obtain a final product having a very small thickness. The temperature at which this hot rolling is carried out is not of great importance from the metallurgical standpoint since, as was mentioned, the steel has an austenitic structure at any temperature and therefore does not undergo a phase transformation which could influence the qualitative result of the hot rolling.

After this optional but preferable hot rolling, the strip may possibly be coiled, here again at a temperature which is of hardly any importance other than from a practical standpoint since no appreciable metallurgical transformation, other than grain growth, is liable to occur during the period during which the coiled strip is cooled at a low rate. In any case, the grain growth will be only of limited extent, the effects of which will be easy to eliminate by the cold-rolling and annealing operations which follow. Optionally, the time during which the strip is in coil form may be the occasion to complete the precipitation of carbides, nitrides and carbonitrides.

The cast strip, which is subsequently hot rolled, then undergoes (directly or after a coiling-uncoiling operation) cold rolling, preferably preceded by acid pickling (for example in hydrochloric acid) making it possible to obtain a good surface finish on the strip. The reduction ratio applied during this cold rolling is from 10 to 90%, typically about 75%. It is obtained in one or more steps. If the starting product is a cast strip from 3 to 4 mm in thickness, which has been reduced to 2.5 to 3 mm in thickness after hot rolling, the result is typically a cold-rolled strip whose thickness is about 0.6–0.8 mm.

Next, the strip undergoes recrystallization annealing which has to give it high tensile strength and ductility properties. This annealing may be carried out in various ways, namely, for example:

annealing called "compact annealing" in which the strip is heated up to a temperature of 900 to 1000° C., or even 1100° C., at a rate of approximately 500° C./s and is then immediately cooled at a rate ranging between 100 and 6000° C./s, which depends on the thickness of the strip and on the characteristics of the coolant; typically, a 0.8 mm thick strip heated to 1000° C. is cooled at 200° C./s if it is quenched in helium and at 5000° C./s if it is quenched in water;

continuous annealing in which the strip is heated to between 800 and 850° C. and maintained at this temperature for 60 to 120 s approximately;

box annealing in which the strip is maintained between 700 and 750° C. for 10 to 90 min. approximately.

In all cases, in the example in question, recrystallized grains with a size of less than 10 $\mu$m are obtained. In general, it may be stated that the high manganese steels according to the invention tolerate a wide variation in annealing conditions, because of their high content of alloying elements which retards the grain growth.

Table 1 shows the tensile properties obtained on a steel of composition C=0.57%, Mn=21.47%, Si=0.038%, Ni=0.03%, Cr=0.005%, Cu=0.003%, P=0.009%, N=0.034%, S=0.005%, Al=0.003% and Mo=0.003%, which has undergone a treatment according to the invention as explained above, comprising the twin-roll casting of a 4 mm thick strip, hot rolling of this strip down to a thickness of 2.6 mm, cold rolling down to a thickness of 1 mm and finally continuous annealing for 90 s at 800° C. By way of comparison, Table 1 also shows the tensile properties of a reference steel obtained by a conventional process for manufacturing strip made of high manganese steel of composition C=0.53%, Mn=26.4%, Si=0.045%, P=0.013%, Al=1.6% and N=0.074%, this being comparable to strip described in the document WO 93/13233. The tensile properties were measured parallel to the rolling direction.

TABLE 1

Comparative tensile properties of a steel according to the invention and a reference steel

| | Invention | Reference |
|---|---|---|
| Young's modulus (GPa) | 197 | 187 |
| Yield stress $Rp_{0.2\%}$ (MPa) | 571 | 441 |
| Ultimate tensile strength (MPa) | 1152 | 881 |
| Uniform elongation (%) | 53.1 | 52.8 |
| Elongation at break (%) | 62.5 | 57.6 |
| Work-hardening coefficient | 0.45 | 0.51 |
| Anisotropy coefficient | 1 | 0.96 |

This table shows in particular that the mechanical strength is improved by more than 30% in the steel of the invention compared with the reference steel. The scatter in the results is less than 4%. This improvement in the mechanical strength is not accompanied by a reduction in the ductility—quite the contrary since the elongation at break is itself considerably increased.

The process for producing the strip may be stopped after the annealing (after possibly pickling the annealed strip) or it may be conventionally completed by a skin-pass operation carried out according to the usual methods.

What is claimed is:

1. A process for producing strip made of an iron-carbon-manganese alloy comprising:

casting a thin strip, having a thickness of 1.5 to 10 mm, directly on a casting machine from a liquid metal composition having, in percentages by weight: C ranging between 0.001 and 1.6%; Mn ranging between 6 and 30%; Ni≦10% and with (Mn+Ni) ranging between 16 and 30%; Si≦2.5%; Al≦6%; Cr≦10%; (P+Sn+Sb+As)≦0.2%; (S+Se+T)≦0.5%; (V+Ti+Nb+B+Zr+rare earths)≦3%; (Mo+W)≦0.5%; N≦0.3%; Cu≦5%, the balance being iron and impurities resulting from the smelting; 0.5%; (V+Ti+Nb+B+Zr+rare earths)≦3%; (Mo+W)≦0.5%; N≦0.3%; Cu≦5%, the balance being iron and impurities resulting from the smelting;

cold rolling said strip with a reduction ratio ranging between 10 and 90% in one or more steps; and recrystallization annealing said strip.

2. The process according to claim 1, characterized in that the carbon content of the said liquid metal ranges between 0.2 and 0.8%.

3. The process according to claim 1, comprising casting said strip between two horizontal rolls which are close together, internally cooled and rotating in opposite directions.

4. The process according to claim 1, comprising hot rolling said strip with a reduction ratio ranging between 10 and 60% in one or more steps between said casting and said cold rolling.

5. The process according to claim 4, comprising passing said strip through a zone having a non-oxidizing atmosphere between said casting and said hot rolling.

6. The process according to claim 4, comprising descaling said strip before said hot rolling.

7. The process according to claim 4, comprising coiling said strip after said casting or said hot rolling and uncoiling said strip before said cold rolling.

8. The process according to claim 1, comprising acid pickling said strip before said cold rolling.

9. The process according to claim 1, wherein said recrystallization annealing is a compact annealing carried out at a temperature of 900 to 1100° C., immediately followed by cooling of said strip at a rate of 100 to 6000° C./s.

10. The process according to claim 1, wherein said recrystallization annealing is a continuous annealing carried out at a temperature of 800 to 850° C. for 60 to 120 s.

11. The process according to claim 1, wherein said recrystallization annealing is a box annealing carried out at a temperature of 700 to 750° C. for 10 to 90 min.

12. The process according to claim 1, comprising acid pickling said strip after said recrystallization annealing.

13. The process according to claim 12, comprising conducting a skin-pass operation on said strip after said recrystallization annealing or said acid pickling.

14. The process according to claim 1, wherein P≦0.2%.

* * * * *